US008871055B2

(12) United States Patent
Ehrhardt

(10) Patent No.: US 8,871,055 B2
(45) Date of Patent: Oct. 28, 2014

(54) SIZING COMPOSITIONS

(75) Inventor: Susan M. Ehrhardt, Haddonfield, NJ (US)

(73) Assignee: Solenis Technologies, L.P., Wilmington, DE (US)

( * ) Notice: Subject to any disclaimer, the term of this patent is extended or adjusted under 35 U.S.C. 154(b) by 0 days.

(21) Appl. No.: 13/435,107

(22) Filed: Mar. 30, 2012

(65) Prior Publication Data

US 2012/0248366 A1 Oct. 4, 2012

Related U.S. Application Data

(60) Provisional application No. 61/470,140, filed on Mar. 31, 2011.

(51) Int. Cl.

| | |
|---|---|
| ***C08G 69/00*** | (2006.01) |
| ***C08G 69/26*** | (2006.01) |
| ***C08G 69/48*** | (2006.01) |
| ***D21H 21/16*** | (2006.01) |
| ***D21H 17/46*** | (2006.01) |
| ***D21H 17/55*** | (2006.01) |
| *D21H 17/62* | (2006.01) |
| *D21H 17/16* | (2006.01) |
| *D21H 17/17* | (2006.01) |
| *D21H 17/52* | (2006.01) |
| *D21H 17/14* | (2006.01) |

(52) U.S. Cl.

CPC ..... *D21H 21/16* (2013.01); *D21H 17/62* (2013.01); *D21H 17/16* (2013.01); *D21H 17/55* (2013.01); *D21H 17/17* (2013.01); *D21H 17/52* (2013.01); *D21H 17/14* (2013.01)

USPC ..... 162/164.6; 162/158; 162/164.1; 524/606; 524/608; 549/233; 549/255; 549/329

(58) Field of Classification Search

USPC ..... 162/158, 164.1, 154.3, 164.6, 162/168.1–168.2, 179, 180, 183, 185; 528/271, 288, 297; 524/1, 599, 606, 524/608; 549/231, 233, 255, 327–329; 252/8.83

See application file for complete search history.

(56) References Cited

U.S. PATENT DOCUMENTS

| | | | | |
|---|---|---|---|---|
| 629,741 | A | 7/1899 | Brown | |
| 2,684,300 | A | 6/1948 | Wilson et al. | |
| 2,628,918 | A | 6/1952 | Wilson et al. | |
| 3,966,654 | A | 6/1976 | Aldrich | |
| 4,040,900 | A | 8/1977 | Mazzarella et al. | |
| 4,317,756 | A | 3/1982 | Dumas | |
| 4,478,682 | A | 10/1984 | Bankert et al. | |
| 4,540,635 | A | 9/1985 | Ronge et al. | |
| 4,861,376 | A | 8/1989 | Edwards et al. | |
| 4,964,915 | A | 10/1990 | Blixt et al. | |
| 5,201,944 | A | 4/1993 | Nakata et al. | |
| 5,685,815 | A | 11/1997 | Bottorff et al. | |
| 5,725,731 | A | 3/1998 | Brungardt et al. | |
| 5,766,417 | A | 6/1998 | Brungardt | |
| 5,846,308 | A | 12/1998 | Lauzon | |
| 5,846,663 | A | 12/1998 | Brungardt et al. | |
| 5,879,814 | A | 3/1999 | Bottorff | |
| 6,093,217 | A * | 7/2000 | Frolich et al. | 8/115.6 |
| 6,123,760 | A | 9/2000 | Varnell | |
| 6,183,550 | B1 | 2/2001 | Conner et al. | |
| 6,238,519 | B1 | 5/2001 | Jones et al. | |
| 6,315,824 | B1 | 11/2001 | Lauzon | |
| 6,702,923 | B1 | 3/2004 | Gorzynski et al. | |
| 2010/0014746 | A1 | 1/2010 | Warnke et al. | |
| 2010/0147476 | A1 * | 6/2010 | Gu et al. | 162/164.6 |
| 2012/0043040 | A1 * | 2/2012 | Zhang et al. | 162/199 |

FOREIGN PATENT DOCUMENTS

| | | |
|---|---|---|
| WO | 9839376 | 9/1998 |
| WO | 0024966 | 5/2000 |
| WO | 2008066487 | 6/2008 |
| WO | 2010059703 | 5/2010 |

OTHER PUBLICATIONS

C.E. Farley and R. B. Wasser, The Sizing of Paper, 2nd Ed., edited by W.F. Reynolds, Tappi Press, dated 1989, pp. 51-62.

International Search Report, PCT/US2012/031374, Jun. 28, 2012, pp. 1-2.

* cited by examiner

*Primary Examiner* — Dennis Cordray

(74) *Attorney, Agent, or Firm* — Joanne Rossi; Michael Herman

(57) ABSTRACT

Disclosed is a sizing composition comprising a hydrophobic paper sizing agent and a hydrophobically modified poly(aminoamide). Also disclosed is a method of making the sizing composition and a method of using the sizing composition.

13 Claims, No Drawings

SIZING COMPOSITIONS

This application claims the benefit of U.S. provisional application No. 61/470,140, filed Mar. 31, 2011, the entire contents of which are hereby incorporated by reference.

INTRODUCTION

This invention relates to novel aqueous dispersions of hydrophobic materials used in the paper industry as sizing agents, e.g., rosin, ASA, AKD, etc. Particularly, this invention relates to aqueous dispersions which contain finely-divided particles of the sizing agent and a hydrophobically-modified poly(aminoamide), particularly preferred is a water soluble alkyl glycidyl ether modified poly(aminoamide), which serves as the dispersing agent for the finely-divided particles in water. The novel aqueous dispersions of this invention exhibit enhanced efficiency when used to size paper.

BACKGROUND

Sizing agents are used in the paper industry to impart resistance to aqueous penetrants to paper and paperboard. The primary products used to provide the property of sizing are rosin, alkenyl succinic anhydride (ASA) and alkyl ketene dimer (AKD). As these hydrophobic materials are insoluble in water, they are typically supplied to the paper machine as aqueous dispersions. This facilitates good mixing with the aqueous pulp slurry if they are added before the sheet is formed (referred to as internal sizing); or with the starch solution if they are added to the surface of the sheet at a size press (referred to as surface sizing).

The aqueous dispersions of these hydrophobic materials must have certain characteristics to be useful for sizing. The emulsions must be stable for a time sufficient to get them from the point of manufacture to the paper machine without loss of properties, physical or chemical. Additionally the emulsions must include a means of retaining the hydrophobic particles on the fiber surfaces.

Manufacture can be at the paper mill (on-site emulsification) if the hydrophobic material is hydrolytically unstable (e.g., ASA), or at a location remote from the paper mill. In the case of dispersions produced at a remote location, the products must be sufficiently high in solids to minimize the cost of shipping, and sufficiently stable to be stored for a period of time long enough to allow for shipping and storage at the mill location.

Due to these requirements, the preparation of emulsions of hydrophobic paper sizing agents has been the basis of numerous patents aiming to improve stability and/or sizing efficiency of the product. For example, Edwards et al. teach stable high solids dispersions of ketene dimer by incorporating water soluble carboxylic acids in a standard starch-based stabilization system (U.S. Pat. No. 4,861,376), Blixt et al. disclose dispersions of ketene dimer with improved sizing efficiency by using cationic starches with a higher degree of substitution (U.S. Pat. No. 4,964,915), Aldrich discloses stable dispersions of fortified rosin using cationic aminopolyamide-epichlorohydrin resins for stabilization (U.S. Pat. No. 3,966,654), Lauzon teaches the stabilization of dispersions of fortified rosin (U.S. Pat. No. 5,846,308) and cellulose reactive sizing agents (U.S. Pat. No. 6,315,824 B1) with a coacervate dispersioning agent comprising an anionic component and a cationic component to improve sizing performance. Dumas teaches the post-addition of cationic polymers to dispersions of hydrophobic cellulose reactive sizing agents to enhance sizing efficiency (U.S. Pat. No. 4,317,756), and Varnell (U.S. Pat. No. 6,123,760) discloses the post-addition of hydrophobically modified water-soluble polymers to aqueous dispersions of hydrophobic paper sizing agents to improve stability.

Frolich et al. (U.S. Pat. No. 6,093,217) disclose aqueous dispersions of cellulose reactive sizing agents stabilized with an anionic, hydrophobically modified cellulose derivative to provide improved sizing in paper making furnishes that have a high cationic demand and/or a high content of lipophilic extractives, and/or paper machines with a high degree of closure. In the specification, the hydrophobically modified cellulose derivative is initially referred to as a "hydrophobically modified dispersing agent", with a long list of possible options provided. It is then stated that the preferred embodiment of this invention also includes a surfactant, which means that the hydrophobically modified cellulose derivative is not functioning as a dispersing agent but instead as a stabilizer. Additionally, no examples are provided with any "hydrophobically modified dispersing agent" other than the anionic hydrophobically modified cellulose derivative.

Conner et al, (U.S. Pat. No. 6,183,550 B1) disclose aqueous dispersions of paper sizing compounds stabilized with a water-soluble dispersant containing "at least two hydrophilic groups and at least one hydrophobic group", referring to a class of compounds called "gemini surfactants". These surfactants can be used as received or in combination with starch or other dispersants to prepare aqueous dispersions.

Hydrophobically modified poly(aminoamides) useful as fixative detackifiers for stickies and pitch control in papermaking systems are disclosed by Q-M Gu, et al. (US 2010/014746 A1).

SUMMARY OF THE INVENTION

It has been found that the hydrophobically modified poly(aminoamides), particularly alkyl glycidyl ether modified poly(aminoamides), can be used to prepare dispersions of hydrophobic paper sizing agents, that provide enhanced sizing efficiency.

A paper sizing composition is disclosed. The composition comprises a dispersion of a reactive or non-reactive sizing agent stabilized with a hydrophobically modified poly(aminoamide), preferably an alkyl glycidyl ether modified poly(aminoamide) prepared as disclosed in US2010/0147476. The pH can be adjusted below 4.0 to provide enhanced stability of the composition. The sizing compositions do not contain wood pulp or cellulose.

A method of preparing sizing compositions is disclosed. The method comprises 1) providing a hydrophobically modified poly(aminoamide) 2) diluting the hydrophobically modified poly(aminoamide) to the appropriate concentration with water; 3) mixing the hydrophobic sizing agent with the diluted hydrophobically modified poly(aminoamide); and 4) homogenizing the mixture using any of the known methods. Particularly preferred hydrophobically modified poly(aminoamide)s are alkyl glycidyl ether modified poly(aminoamide)s.

A method of preparing stable sizing compositions is disclosed. The method comprises 1) adjusting the pH of a hydrophobically modified poly(aminoamide), preferably alkyl glycidyl ether modified poly(aminoamide) below about 4.0; 2) diluting the pH-adjusted hydrophobically modified poly(aminoamide) with water to the appropriate concentration (steps 1 and 2 can be reversed); 3) mixing a hydrophobic sizing agent with the pH-adjusted hydrophobically modified poly(aminoamide); and 4) homogenizing the mixture using any of the known methods. pH adjustment provides for enhanced stability of the final composition.

DETAILED DESCRIPTION OF INVENTION

A paper sizing composition is disclosed. The composition comprises a dispersion of a reactive or non-reactive sizing agent stabilized with a hydrophobically modified poly(aminoamide). Optionally, the pH can be adjusted below 4.0 to provide enhanced stability of the composition. Also disclosed is a method of making the paper sizing composition. Also disclosed is a method of sizing paper using the sizing compositions of the present invention.

In one embodiment the sizing compositions are prepared by 1) providing an aqueous solution of hydrophobically modified poly(aminoamide); 2) diluting the hydrophobically modified poly(aminoamide) to the appropriate concentration; 3) mixing a hydrophobic sizing agent with the hydrophobically modified poly(aminoamide); and 4) homogenizing the mixture using any of the known methods.

One embodiment of the invention provides for a paper sizing composition comprising dispersions of a hydrophobic paper sizing agent that are stable and provide enhanced sizing efficiency. The stable paper sizing compositions contain a hydrophobically modified poly(aminoamide), preferably alkyl glycidyl ether modified poly(aminoamide), prepared as disclosed in US2010/0147476 and a hydrophobic paper sizing agent.

In one embodiment the sizing compositions are prepared by 1) adjusting the pH of the hydrophobically modified poly (aminoamide) below about 4.0; 2) diluting the pH-adjusted hydrophobically modified poly(aminoamide) to the appropriate concentration (steps 1 and 2 can be reversed); 3) mixing hydrophobic sizing agent with the pH-adjusted hydrophobically modified poly(aminoamide); and 4) homogenizing the mixture using any of the known methods. pH adjustment provides for enhanced stability of the sizing composition.

Though technically imprecise, the terms 'dispersion' and 'emulsion' will be used interchangeably in this document. The term emulsion refers to a two phase system with liquid droplets in a continuous liquid medium, and the term dispersion refers to a two phase system with solid particles in a continuous liquid medium. The physical state of the sizing agent is dependent on the nature of the sizing agent and temperature of the system; commercial sizing agents can be liquid or solid. As a result, the two terms are used interchangeably when referring to commercial sizing agents in the paper industry and this patent.

Preferred hydrophobic paper sizing compounds for the dispersed phase of the invention are selected from the group consisting of cellulose reactive paper sizing compounds and cellulose non-reactive paper sizing compounds. For the purposes of this invention cellulose-reactive sizing agents are defined as those sizes capable of forming covalent chemical bonds by reaction with the hydroxyl groups of cellulose, and cellulose non-reactive sizing agents are defined as those that do not form these covalent bonds with cellulose.

Preferred cellulose-reactive sizes for use in the invention include alkenyl succinic anhydrides (ASA), alkyl ketene dimers (AKD) and multimers, organic epoxides containing from about 12 to 22 carbon atoms, acyl halides containing from about 12 to 22 carbon atoms, fatty acid anhydrides from fatty acids containing from about 12 to 22 carbon atoms and organic isocyanates containing from about 12 to 22 carbon atoms. Mixtures of reactive sizing agents may also be used. ASA and AKD are most preferred.

Alkenyl succinic anhydrides (ASA) are composed of unsaturated hydrocarbon chains containing pendant succinic anhydride groups. They are usually made in a two-step process starting with an alpha olefin. The olefin is first isomerized by randomly moving the double bond from the alpha position. In the second step the isomerized olefin is reacted with maleic anhydride to give the final ASA. Typical olefins used for the reaction with maleic anhydride include alkenyl, cycloalkenyl and aralkenyl compounds containing from about 8 to about 22 carbon atoms. Specific examples are isooctadecenyl succinic anhydride, n-octadecenyl succinic anhydride, n-hexadecenyl succinic anhydride, n-dodecyl succinic anhydride, i-dodecenyl succinic anhydride, n-decenyl succinic anhydride and n-octenyl succinic anhydride.

Alkenyl succinic anhydrides ("ASA") are disclosed in U.S. Pat. No. 4,040,900, which is incorporated herein by reference in its entirety, and by C. E. Farley and R. B. Wasser in The Sizing of Paper, Second Edition, edited by W. F. Reynolds, Tappi Press, 1989, pages 51-62. A variety of alkenyl succinic anhydrides are commercially available.

Alkenyl succinic anhydrides used by papermakers typically contain surfactants to facilitate their emulsification in water. The surfactants used for ASA emulsification are well known in this art. Suitable surfactants include, but are not limited to, phosphated ethoxylates which may contain alkyl, aryl, aralkyl or alkenyl hydrocarbon substituents, sulfonated products such as those obtained from sulfonating fatty alcohols or aromatic fatty alcohols, ethoxylated alkyl phenols such as nonyl phenoxy polyethoxy ethanols and octyl phenoxy polyethoxy ethanols, polyethylene glycols such as PEG 400 monooleate and PEG 600 dilaurate, ethoxylated phosphate esters, dialkyl sulfosuccinates such as sodium dioctyl sulfosuccinate, polyoxyalkylene alkyl or polyoxyalkylene alkylaryl ethers or corresponding mono- or di-esters, and trialkyl amines and their acid and quaternary salts as well as amine hydrates such as oleyl dimethylamine and stearyl dimethylamine. Surfactants can be present in the hydrophobic paper sizing compounds used in this present invention in amounts known to those skilled in the art.

Preferred ketene dimers and multimers are materials of formula (1), wherein n is an integer of 0 to about 20, R and R", which may be the same or different, are saturated or unsaturated straight chain or branched alkyl or alkenyl groups having 6 to 24 carbon atoms; and R' is a saturated or unsaturated straight chain or branched alkylene group having from about 2 to about 40 carbon atoms.

(1)

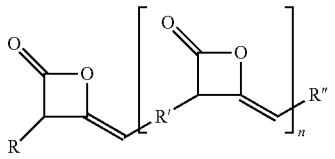

Ketene dimers for use as the dispersed phase in the process of this invention have the structure of formula (1) where n=0 and the R and R" groups, which can be the same or different, are hydrocarbon radicals. Preferably the R and R" groups are straight chain or branched alkyl or alkenyl groups having 6 to 24 carbon atoms, cycloalkyl groups having at least 6 carbon atoms, aryl groups having at least 6 carbon atoms, aralkyl groups having at least 7 carbon atoms, alkaryl groups having at least 7 carbon atoms, and mixtures thereof. More preferably, ketene dimer is selected from the group consisting of (a) octyl, decyl, dodecyl, tetradecyl, hexadecyl, octadecyl, eicosyl, docosyl, tetracosyl, phenyl, benzyl, β-naphthyl, and cyclohexyl ketene dimers, and (b) ketene dimers prepared from organic acids selected from the group consisting of montanic acid, naphthenic acid, 9,10-decylenic acid, 9,10-dodecylenic acid, palmitoleic acid, oleic acid, ricinoleic acid, linoleic acid, eleostearic acid, naturally occurring mixtures of fatty acids found in coconut oil, babassu oil, palm kernel oil, palm oil, olive oil, peanut oil, rape oil, beef tallow, lard, whale blubber, and mixtures of any of the above named fatty acids with each other. Most preferably ketene dimer is selected from the group consisting of octyl, decyl, dodecyl, tetradecyl, hexadecyl, octadecyl, eicosyl, docosyl, tetracosyl, phenyl, benzyl, β-naphthyl, and cyclohexyl ketene dimers.

Alkyl ketene dimers have been used commercially for many years and are prepared by dimerization of the alkyl ketenes made from saturated, straight chain fatty acid chlorides; the most widely used are prepared from palmitic and/or stearic acid. Neat alkyl ketene dimer is available as AQUAPELT™ 364 sizing agent (Hercules Incorporated Wilmington, Del.).

Preferred ketene multimers for use as the dispersed phase in the process of this invention have the formula (2) where n is an integer of at least 1, R and R", which may be the same or different, are saturated or unsaturated straight chain or branched alkyl or alkenyl groups having 6 to 24 carbon atoms, preferably 10 to 20 carbon atoms, and more preferably 14 to 16 carbon atoms, and R' is a saturated or unsaturated straight chain or branched alkylene group having from 2 to 40 carbon atoms, preferably from 4 to 8 or from 28 to 40 carbon atoms.

Preferred ketene multimers are described in: European Patent Application Publication No. 0 629 741 A1, and in U.S. Pat. Nos. 5,685,815 and 5,846,663, all of which are incorporated herein by reference in their entireties.

Among the preferred ketene dimers and multimers for use as the dispersed phase in the invention are those which are not solid at 25° C. (not substantially crystalline, semi-crystalline or waxy solid; i.e., they flow on heating without heat of fusion). Ketene dimers and multimers not solid at 25° C. are disclosed in U.S. Pat. Nos. 5,685,815, 5,846,663, 5,725,731, 5,766,417 and 5,879,814, all of which are incorporated herein by reference in their entireties. Ketene dimers not solid at 25° C. are available as PREQUELT™ and PRECIS™ sizing agents (Hercules Incorporated, Wilmington, Del.).

Other preferred cellulose-reactive sizes for use as the dispersed phase in the invention are mixtures of ketene dimers or multimers with alkenyl succinic anhydrides as described in U.S. Pat. No. 5,766,417, which is incorporated herein by reference in its entirety.

Non-cellulose reactive sizing agents include rosins, e.g. fortified and/or esterified rosin, waxes, fatty acid and resin acid derivatives. Rosin is preferred. The rosin useful for the present invention can be any modified and unmodified rosin suitable for sizing paper, including unfortified rosin, fortified rosin and extended rosin, as well as rosin esters, and mixtures and blends thereof.

The rosin used in this invention can be any of the commercially available types of rosin, such as wood rosin, gum rosin, tall oil rosin, and mixtures of any two or more, in their crude or refined state. Tall oil rosin and gum rosin are preferred. Partially hydrogenated rosins and polymerized rosins, as well as rosins that have been treated to inhibit crystallization, such as by heat treatment or reaction with formaldehyde, also can be employed.

A fortified rosin useful in this invention is the adduct reaction product of rosin and an acidic compound containing the

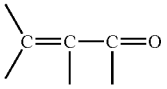

group and is derived by reacting rosin and the acidic compound at elevated temperatures of from about 150 C to about 210 C.

The amount of acidic compound employed will be that amount which will provide fortified rosin containing from about 1 to about 16% by weight of adducted acidic compound based on the weight of the fortified rosin. Methods of preparing fortified rosin are well known to those skilled in the art. See, for example, the methods disclosed and described in U.S. Pat. Nos. 2,628,918 and 2,684,300, the disclosures of which are incorporated herein by reference.

Examples of acidic compounds that can be used to prepare the fortified rosin include the alpha-beta-unsaturated organic acids and their available anhydrides, specific examples of which include fumaric acid, maleic acid, acrylic acid, maleic anhydride, itaconic acid, itaconic anhydride, citraconic acid and citraconic anhydride. Mixtures of acids can be used to prepare the fortified rosin if desired. Thus, for example, a mixture of the acrylic acid adduct of rosin and the fumaric acid adduct can be used to prepare the novel dispersions of this invention. Also, fortified rosin that has been substantially completely hydrogenated after adduct formation can be used.

Various rosin esters of a type well known to those skilled in the art can also be used in this invention. Suitable exemplary rosin esters may be esterified as disclosed in the U.S. Pat. No. 4,540,635 or 5,201,944, the disclosures of which are incorporated herein by reference.

The unfortified or fortified rosin or rosin esters can be extended if desired by known extenders therefore such as waxes (particularly paraffin wax and microcrystalline wax); hydrocarbon resins including those derived from petroleum hydrocarbons and terpenes; and the like. This is accomplished by melt blending or solution blending with the rosin or fortified rosin from about 10% to about 100% by weight, based on the weight of rosin or fortified rosin, of the extender.

Also blends of fortified rosin and unfortified rosin; and blends of fortified rosin, unfortified rosin, rosin esters and rosin extender can be used. Blends of fortified and unfortified rosin may comprise, for example, about 25% to 95% fortified rosin and about 75% to 5% unfortified rosin. Blends of fortified rosin, unfortified rosin and rosin extender may comprise, for example, about 5% to 45% fortified rosin, 0 to 50% rosin and about 5% to 90% rosin extender.

The rosin component of the compositions of this invention may vary depending on the type and grade of paper or paperboard being sized, the equipment used and whether the size is an internal or surface size.

The dispersants used to prepare the sizing compositions of this invention are the hydrophobically modified poly(aminoamides). Such polymers are prepared via modification of amine-containing water-soluble poly(aminoamides) with reactive functional group-containing hydrophobic compounds as disclosed in US Pat Appln 2010/014746 A1, the disclosures of which are incorporated herein by reference.

The general composition of a preferred alkyl glycidyl ether modified poly(aminoamide) as a dispersant for this invention has the following formula:

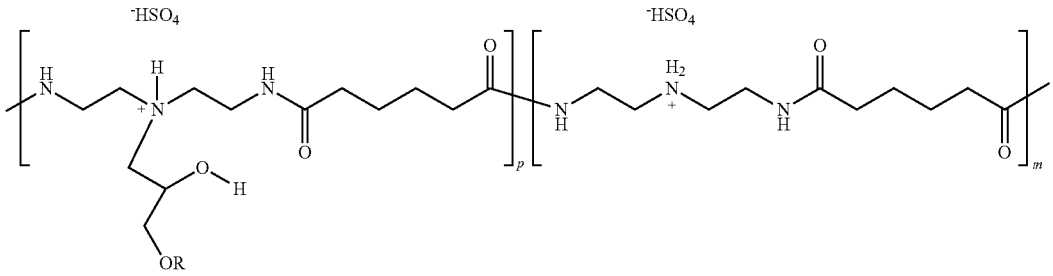

wherein R is a straight chain or branched aliphatic or olefinic group having up to 22 carbon atoms and up to 4 double bonds, preferably 8-12; p represents the randomly distributed poly (aminoamide) units that are modified by an alkyl glycidyl ether; m represents the randomly distributed unmodified poly (aminoamide); p and m are integers in the range of from 10 to 1000, more preferably 20-500, most preferably 80-100. The ratio of p/m is in the range of from 0.01 to 10, preferably 0.05 to 0.25, most preferably 0.08 to 0.2.

Any difunctional or multi-functional crosslinker can be used to crosslink the alkyl glycidyl ether modified poly(aminoamide) to prepare higher molecular weight materials for the present invention. The examples of those difunctional or multi-functional crosslinkers are: epihalohydrin, epichlorohydrin, alkyl diepoxide, 1,3-butadiene, polyepoxide, alkyl diglycidyl ether, trimethylolpropane triglycidyl ether, neopentyl glycol diglycidyl ether, diglycidyl 1,2-cyclo-hexanecarboxylate, dihaloalkane, dichloromethane, dichloroethane, 3-glycidoxypropyltrimethoxysilane, alkyl diisocyanate, polyisocyanate, maleic anhydride-based polymers, tris(2,3-epoxypropyl) isocyanurate, 1,4 butanediol diglycidyl ether, glycerol triglycidyl ether, polyethylene glycol diglycidyl ether, dialdehydes, ethylene glycol diacrylate, methylenebisacrylamide, 1,4-butanediol diacrylate, bisphenol diacrylate, polyethylene glycol diacrylate, hexanediol diacrylate, 1,10-decanediol diacrylate, dicyclopentenyl acrylate, dicyclopentenyl methacrylate, polyethoxy methacrylatemethacrylate, phenylthioethyl acrylate, polyfunctional acrylamide, polyfunctional acrylates, polyfunctional methacrylates, polyfunctional maleates, a metal halide, aluminum chloride, aluminum bromide, indium trichloride, gallium trichloride, tantalum pentachloride, titanium tetrachloride, boron trifluoride, boron trifluoride etherate, boron trichloride, and zirconium chloride.

The sizing compositions of this invention can be prepared by providing an aqueous phase comprising the hydrophobically modified poly(aminoamide). Diluting the hydrophobically modified poly(aminoamide) to an appropriate concentration and optionally adjusting the pH to a stable pH below about pH 4.0 or preferably pH below 3.5, and more preferably a pH between 3.0 and 2.0. The optional pH adjustment can be made using mineral or organic acids. The pH adjustment can be made on the neat polymer before dilution or on the aqueous phase.

In one embodiment, the sizing compositions of this invention are prepared by providing an aqueous phase comprising the alkyl glycidyl ether modified poly(aminoamide). The aqueous phase is prepared by diluting the alkyl glycidyl ether modified poly(aminoamide) to an appropriate concentration and adjusting the pH to a stable pH below about pH 4.0. A pH below 3.5 is preferred, and more preferably a pH between 3.0 and 2.0 is most preferred. The pH adjustment can be made using mineral or organic acids. The pH adjustment can be made on the neat polymer before dilution or on the aqueous phase.

The appropriate concentration of the hydrophobically modified poly(aminoamides), preferably alkyl glycidyl ether modified poly(aminoamide), is the minimum level necessary to prepare stable emulsions, but can include additional resin to achieve the desired paper machine performance. The concentration of active hydrophobically modified poly(aminoamides, preferably alkyl glycidyl ether modified poly(aminoamide), can range from 0.5 to 50% based on hydrophobic sizing agent (dry weight basis). The preferred range is 1 to 20%. The most preferred range is 2 to 10%, based on hydrophobic sizing agent.

The aqueous phase may include other additives common to size emulsions, such as alum, defoamers, biocides and other preservatives in amounts and using techniques known to those skilled in the art.

The aqueous phase is combined with the hydrophobic paper sizing agent to form a coarse oil in water emulsion referred to as the premix. The premix is then subjected to sufficient shear to provide an essentially stable oil in water emulsion. Sufficient shear is conveniently accomplished by means of a homogenizer, although the dispersing agent of this invention allows the use of considerably less sophisticated equipment, such as a Waring blendor. On a commercial scale, passing the unstable aqueous mixture through a homogenizer under a pressure of from about 100 psig (7 kg/cm2) to about 8,000 psig (560 kg/cm2), preferably about 2000 psig (140 kg/cm2) to about 3000 psig (210 kg/cm2) will provide an essentially stable emulsion.

The levels of hydrophobic paper sizing agent and hydrophobically modified poly(aminoamide) in the aqueous dispersions of the invention depend, in part, on the particular sizing agent used, the particular hydrophobically modified poly(aminoamide)s and the intended application. Preferably the level of hydrophobic sizing agent is from about 1 to about 60%, and more preferably from about 5 to about 50% (dry weight basis).

To form the dispersion the hydrophobic paper sizing agent must be in a liquid state. If the hydrophobic paper sizing agent is not a liquid at ambient temperature, the liquid state can be achieved by using temperatures above the melting point of the hydrophobic paper sizing agent throughout the process. If the melting point of the hydrophobic paper sizing agent is above the boiling point of water, the process can be run under pressure to accommodate temperatures above 100° C. This is necessary for the preparation of dispersions of fortified rosin, for example. A liquid state can also be achieved by dissolving the hydrophobic paper sizing agent in a solvent. The solvent would then be removed after homogenization. Such processes are known in the art and are described, for example, in U.S. Pat. No. 5,846,308.

Other additives, such as, but not limited to, defoamers, biocides and other preservatives, and alum can be added to the stable dispersion of the present invention in amounts and using techniques known to those skilled in the art.

The final product is a dispersion of the hydrophobic paper sizing agent stabilized with the hydrophobically modified poly(aminoamide), preferably alkyl glycidyl ether modified poly(aminoamide). The level of shear used to prepare the final product will influence the size of the particles comprising the dispersed phase. However, it is possible to achieve relatively small particles; dispersions with a mean particle size of about 0.3 um are typical. The product is of relatively low viscosity, <50 cps, with good physical stability. The product is shear stable, as indicated by a lab pump stability test. The final emulsion pH should be less than about pH 3.

The emulsions of this invention are physically stable. For the purposes of this patent, a dispersion is said to be physically stable if viscosity does not exceed about 400 cps over 4 weeks storage at 32° C. The dispersions of ketene dimer of this invention are also chemically stable. A dispersion is said to be chemically stable if the loss of assay is no more than about 10% over 4 weeks storage at 32° C. Assay refers to the amount of ketene dimer present in the initial emulsion formulation. The ketene dimer can react with water over time to form what is commonly referred to as the diketone, which results in a loss of assay. The diketone is not an effective sizing agent, so it is desirable to keep this loss to a minimum.

Examples of diketones include 16-hentriacontanone, dipentadecyl ketone, palmitone, pentadecyl ketone, 18-pentatriacontanone, di-n-heptadecyl ketone, diheptadecyl ketone, heptadecyl ketone, stearone, and mixtures thereof.

The sizing compositions prepared by this invention may be used in internal sizing in which the sizing compositions are added to the pulp slurry in the wet end of the paper making process, or surface sizing in which the sizing compositions are applied at the size press or the coater. This invention may also be used in one or both parts of a two-part sizing system. For example, one part may be mixed internally with the wood pulp and a second part applied at the size press, a common practice in papermaking.

The amount of sizing composition of the present invention either added to the stock or applied as a surface size is from about 0.005 to 5% by weight of active hydrophobic sizing agent, based on the dry content of the stock, i.e., fibers and optional filler, and preferably from 0.01 to 1% by weight. The dosage is mainly dependent on the quality of the pulp or paper to be sized, the sizing compound used and the level of sizing desired.

The sizing compositions prepared by this invention are more effective in some papermaking systems than conventional sizing agents, such as those stabilized with cationic starch. The higher cationic charge and typically smaller particle size are thought to improve the retention and distribution of the active hydrophobic sizing agent in the paper or paperboard. These improvements result in greater sizing efficiency, reducing the amount of active hydrophobic sizing agent required to meet any given sizing target. In some embodiments of the invention the amount of active hydrophobic sizing agent can be reduced by at least 25% or greater when compared to using the conventional starch or cationic starch stabilized sizing agent. In some embodiments of the invention the amount of active hydrophobic sizing agent can be reduced by at least 30% or greater.

Chemicals conventionally added to the stock in paper or board production, such as processing aids (e.g., retention aids, drainage aids, contaminant control additives, etc.) or other functional additives (e.g., wet or dry strength additives, dyes, optical brightening agents, etc.) can be used in combination with the sizing agents of this invention.

EXAMPLES

The following examples are given for the purpose of illustrating the present invention. All parts and percentages are by weight unless otherwise indicated.

In the following examples, sizing evaluations were made using a pilot scale paper machine designed to simulate a commercial Fourdrinier, including stock preparation, refining and storage. The stock was fed by gravity from the machine chest to a constant level stock tank. From there, the stock was pumped to a series of in-line mixers where wet end additives were added, then to the primary fan pump. The stock was diluted with white water at the fan pump to about 0.2% solids. Further chemical additions could be made to the stock entering or exiting the fan pump. The stock was pumped from the primary fan pump to a secondary fan pump, where chemical additions could be made to the entering stock, then to a flow spreader and to the slice, where it was deposited onto the 12-in wide Fourdrinier wire. Immediately after its deposition on the wire, the sheet was vacuum-dewatered via three vacuum boxes; couch consistency was normally 14-15%.

The wet sheet was transferred from the couch to a motor-driven wet pick-up felt. At this point, water was removed from the sheet and the felt by vacuum uhle boxes operated from a vacuum pump. The sheet was further dewatered in a single-felted press and left the press section at 38-40% solids.

Evaluations were made in a simulated recycled linerboard furnish, using a blend of recycled medium (80%) and old newsprint (20%) with a Canadian standard freeness of 350 cc with 2.75% sodium lignosulfonate added to simulate anionic trash. The hardness and alkalinity were about 126 ppm and about 200 ppm, respectively. Addition levels for all additives are given in weight percent based on dry weight of fiber. 0.3% cationic dent corn starch (Sta-Lok 300, Tate & Lyle) was added to the thick stock before the addition of the sizing agent. No other wet end additives were used unless otherwise noted. Stock temperature was maintained at 55 C. The headbox pH was controlled to 7.5 with caustic unless otherwise noted.

A 171 g/sq m (105 lb/3000 ft2 ream) sheet was formed and dried on seven dryer cans to about 7% moisture (dryer can surface temperatures at 90 C) and passed through a single nip of a 5-nip, 6 roll calender stack. HST (Hercules Sizing Test, see Tappi Method T530 om-02) and Cobb (Tappi Method T441 om-04) sizing were measured on board naturally aged in a CT room (50% RH, 25 C) for a minimum of 7 days.

Control AKD emulsion: Hereon® 115 Sizing Agent, a promoted, cationic starch stabilized emulsion of alkyl ketene dimer (Hercules Incorporated, Wilmington Del.).

Control rosin emulsion: Hi-pHase 35 sizing agent, a cationic resin stabilized emulsion of adducted rosin (Hercules Incorporated, Wilmington Del.).

C8-alkyl glycidyl ether modified poly(aminoamide) (C8-AGE-MPA): Available from Hercules Incorporated as Hercules PTV D-38470 Contaminant Control Agent (Hercules Incorporated, Wilmington Del.). 32% total solids.

C12-alkyl glycidyl ether modified poly(aminoamide) (C12-AGE-MPA): Prepared as described in Example 1 of US Pat Appln 2010/0147476 A1.

C16-alkyl glycidyl ether modified poly(aminoamide) (C16-AGE-MPA): Prepared using the procedure as described in US Pat Appln 2010/0147476 A1. The detailed procedure is as follows: A poly(aminoamide) solution (Hercules Incorporated, Wilmington, Del., AN04 Polymer, 50%, 100 g) was charged to a 250-ml reaction flask equipped with a mechanical agitator, thermocouple, and a Dean Stark trap. The solution was heated to 170° C. and remained at this temperature for 3 hours with stirring. Water was collected by the Dean Stark trap and removed. The contents were cooled to 160° C. and C16 alkyl glycidyl ether (HAGE 16, 98%, SaChem, Austin, Tex., 733 g, 10 mole % based on the moles of amine used) was charged over 5 minutes. The resulting mixture was stirred at 140° C. for 2 hours. After reaction, the materials were diluted in water, the pH adjusted with 50% H2SO4, and mixed until homogenous to yield a 22.0 wt % solids solution with a pH of 6.7.

Example 1

Preparation of Stable AKD Dispersions According to the Invention

An aqueous phase is prepared by dissolving 5.52 parts C8-AGE-MPA in 79.38 parts water and adjusting the pH to 3.0 with 10% sulfuric acid. The aqueous phase is heated to 80-85 C. 15 parts Aquapel 364 sizing agent (available from Hercules Incorporated, Wilmington Del.) are added to the hot aqueous phase, while stirring. The resulting premix is homogenized in one pass through a homogenizer at 3000 psi. The homogenized product is cooled to room temperature and 0.1 parts alum are added. The final product is 16.6% total solids with a pH of 3.1, a mean particle size of 0.31 microns and an initial Brookfield viscosity of 5 cps. After 4 weeks at 32 C, the viscosity is unchanged.

Example 2

Variation in C8-AGE-MPA Level

AKD dispersions were prepared as in Example 1 using Aquapel 203 sizing agent (available from Hercules Incorporated, Wilmington Del.), varying the amount of C8-AGE-MPA used to prepare the aqueous phase. Formulations and product characteristics are as listed in Table 1. The quality of the emulsion (particle size, stability) improves as the level of resin is increased above about 0.5% based on total emulsion (or about 1.5% based on dispersed phase).

TABLE 1

HMPA level above about 0.5% based on total emulsion necessary for good stability

| | A | B | C |
|---|---|---|---|
| Ingredients: | | | |
| AKD | 30.0 pph | 30.0 | 30.0 |
| C8-AGE-MPA | 5.7 | 2.9 | 1.4 |
| water | 64.3 | 67.1 | 68.6 |
| Properties: | | | |
| Total Solids, % | 32 | 31 | 31 |
| Mean Particle Size, um | 0.28 | 0.5 | 1.15 |
| Viscosity, cps | | | |
| As made | 9 | 6 | 6 |
| 1 week | 11 | | separating |

Example 3

Preparation of Stable Rosin Dispersions According to the Invention

Adduct Preparation: Fumaric acid, 70 parts at 99% solids, is reacted at elevated temperatures with tall oil rosin, 930 parts. The fumaric acid dissolves in the molten rosin and reacts therewith to provide a reaction product. The reaction product, after substantially all the fumaric acid has reacted with the gum rosin, is allowed to cool to room temperature (about 23 C). The product is a mixture comprised of unmodified rosin and rosin-fumaric acid reaction product, or adduct. The reaction product contains 7 wt % fumaric acid, substantially all of which has been reacted.

Emulsion preparation: The oil phase is prepared by dissolving 145.78 parts adduct in 145.78 parts of methylene chloride. The aqueous phase is prepared by dissolving 23.99 parts C8-AGE-MPA in 184.8 parts water and adjusting the pH to 3.0 with 98% sulfinic acid. The aqueous and oil phases are thoroughly mixed to provide a coarse oil-in-water emulsion. The coarse emulsion is homogenized using a lab sonicator. The product is an oil-in-water emulsion of excellent stability. Substantially all methylene chloride is removed from the oil-in-water emulsion by distillation at reduced pressure to provide an aqueous dispersion which is passed through a paint filter. The aqueous suspension, after passage through the filter, has a solids content of 43.3%, a pH of 2.7, a mean particle size of 0.29 um and an as made viscosity of 18 cps which slightly decreased on aging at 32 C, dropping to 15 cps after 4 weeks.

Example 4

Preparation of Stable Rosin Dispersions with Additional Alum

To 67 parts of a rosin dispersions such as that prepared in Example 3 were added 23 parts alum and 10 parts water, with mild agitation. The resultant blend was stable with an as made viscosity of 10 cps that did not change on aging for 4 weeks at 32 C.

Example 5

Preparation of ASA Emulsions According to the Invention 2.2 parts C8-AGE-MPA was dissolved in 291.8 parts water and the pH adjusted to 3.0 with 98% sulfuric acid. 6 parts Prequel 1000 sizing agent (an ASA available from Hercules Incorporated, Wilmington Del.; Prequel 1000 contains a low level of surfactant to facilitate emulsification) was added to this solution and the mixture was processed in a Waring blendor on high speed for 2 min. The resultant emulsion was homogeneous and had a mean particle size of 0.62 um. ASA emulsions are used immediately after preparation because the ASA is hydrolytically unstable. Therefore long term stability is not monitored.

Example 6

Improved Sizing Performance of AKD Dispersions

The AKD dispersion from Example 1 was evaluated in a RLB furnish, as described above. The sizing agent of this invention was more than 30% more effective than the control.

TABLE B

Sizing agents of this invention are more effective in RLB than standard AKD emulsions.

| Sizing Agent | Addn. % | HST * Mean (Seconds) | Cobb Test Mean (g/sq m) |
|---|---|---|---|
| blank | 0.00 | 1 | 413.5 |
| Ex. 1 | 0.075 | 11 | 178.5 |
| Ex. 1 | 0.100 | 19 | 143.0 |
| Ex. 1 | 0.150 | 67 | 51.0 |
| Hercon 115 | 0.075 | 9 | 270.5 |
| Hercon 115 | 0.100 | 9 | 270.0 |
| Hercon 115 | 0.150 | 30 | 126.0 |

Sample was aged for 7 days prior to measuring HST and Cobb

HST was measured using, 20% Formic Acid Ink/80% Reflectants, average of 5 repetitions. Cobb Test was measured using Water and a 2 minute soak, average of 2 repetitions.

Example 7

Emulsions of Reactive Sizing Agents Made with C12-AGE-MPA and C16-AGE-MPA

An emulsion of Aquapel 203 was prepared as in Example 2A using an alternative alkyl glycidyl ether modified poly (aminoamide). Product characteristics are as listed in Table 2.

TABLE 2

Alternative HMPA resins work well

| | A C8-AGE-MPA | B C16-AGE-MPA |
|---|---|---|
| Properties: | | |
| Total Solids, % | 32 | 32 |
| Mean Particle Size, um | 0.28 | 0.3 |
| Viscosity, cps | | |
| As made | 9 | — |
| 1 week | 11 | 8 |

An emulsion of ASA was prepared as in Example 5 using C12-AGE-MPA. In this case 36.6 parts C12-AGE-MPA was dissolved in 203.4 parts water, the pH was adjusted to 3.0 with 98% sulfuric acid, and 60 parts Prequel 1000 were added. The emulsion was processed as in Example 5. The resultant emulsion was homogeneous and had a mean particle size of 0.59 um.

Example 8

AKD Dispersions Prepared without pH Adjustment of Aqueous Phase

Dispersions of Aquapel 364 were prepared as in Example 1, without adjustment of the aqueous phase. The natural pH of the aqueous phase was 5.1. The pH of the final emulsion, after alum addition, was 3.4. The emulsion was not stable at 32 C.

TABLE 3

Emulsions made at natural pH are not stable

| | A pH adjusted | B Natural pH |
|---|---|---|
| Properties: | | |
| Total Solids, % | 16.6 | 16.5 |
| Mean Particle Size, um | 0.3 | 0.31 |
| pH | 2.8 | 3.4 |
| Viscosity, cps | | |
| As made | 6 | 4 |
| 1 week, 32 C | 4 | gelled |
| 2 week, 32 C | 9 | gelled |

Example 9

AKD Dispersions Prepared Using Other Resins as Dispersants

Dispersions of Aquapel 364 were prepared as in Example 1, substituting other cationic resins for the alkyl glycidyl ether modified poly(aminoamides), as listed in Table 4. Reten 203 is polyDADMAC at 20% solids (available from Hercules Incorporated, Wilmington Del.).

TABLE 4

Other cationic resins do not produce stable products

| | A C8-AGE-MPA | B Reten 203 |
|---|---|---|
| Properties: | | |
| Total Solids, % | 16.6 | 16.6 |
| Mean Particle Size, um | 0.3 | 0.91 |
| pH | 2.8 | 2.6 |
| Viscosity, cps | | |
| As made | 6 | 16 |
| 1 week, 32 C | 4 | 318 |
| 2 week, 32 C | 9 | gelled |

Example 10

Improved Performance of Rosin Dispersions

The adduct was prepared following the same procedure as outlined in Example 3, substituting maleic anhydride for the fumaric acid and gum rosin for the tall oil rosin. The emulsion was prepared as in Example 3, except the maleic anhydride adduct of gum rosin was used in place of the fumaric acid adduct of TOR.

Sizing performance was evaluated in a RLB furnish as described above with the exception that 0.5% alum was added to the pulp slurry with the dispersed rosin sizing agent, and the headbox pH was controlled at 6.8.

TABLE 5

Dispersed rosin sizing agents of this invention are at least 25% more effective than existing product technology in RLB:

| Sizing Agent | % ADDITION | COBB TEST Number of Reps 2 2 min/Water felt side g/sq m Mean | HST Number of Reps 5 10% FA Ink/80% Refl. felt side seconds Mean |
|---|---|---|---|
| Blank | 0.000 | 279 | 1 |
| Hi-pHase 35 | 0.350 | 207 | 13 |
| Hi-pHase 35 | 0.550 | 121 | 50 |
| Hi-pHase 35 | 0.700 | 97 | 47 |
| Hi-pHase 35 | 1.000 | 41 | 125 |
| Example 10 | 0.350 | 156 | 26 |
| Example 10 | 0.550 | 54 | 73 |
| Example 10 | 0.700 | 40 | 97 |
| Example 10 | 1.000 | 34 | 175 |

Example 11

Improved Sizing Performance of ASA Emulsions

The emulsion of Example 5 was evaluated in a RLB furnish, as described above, with the exception that 0.2% alum was added to the pulp slurry immediately before the sizing agent. The control in this example was an ASA emulsion made in a Waring blendor as in Example 5, except a liquid starch (Prequel 630 available from Hercules Inc, Wilmington Del.) was used to stabilize the dispersion, there was no pH adjustment of the aqueous phase and an ASA to starch (dry basis) ratio of 3:1 was used. The ASA emulsions of this example are more effective for Cobb sizing than this standard starch-stabilized product.

TABLE 6

ASA emulsions of this invention are more effective than starch-stabilized products in RLB.

| SIZING AGENT | % ADDITION | COBB TEST Number of Reps 2 2 min/Water g/sq m Mean | COBB TEST Number of Reps 2 30 min/Water g/sq m Mean |
|---|---|---|---|
| blank | | 336.0 | 528.0 |
| Starch-stabilized | 0.150 | 109.0 | 237.5 |
| Starch-stabilized | 0.200 | 70.5 | 158.5 |
| Starch-stabilized | 0.300 | 41.0 | 107.0 |
| Example 5 | 0.150 | 115.0 | 343.0 |
| Example 5 | 0.200 | 44.0 | 128.5 |
| Example 5 | 0.300 | 31.0 | 85.5 |

The invention claimed is:

1. An aqueous paper sizing composition comprising a hydrophobic paper sizing agent homogenized with an aqueous solution of a hydrophobically modified poly(aminoamide) having a pH below 4.0; wherein the hydrophobically modified poly(aminoamide) is a water soluble alkyl glycidyl ether modified poly(aminoamide); and wherein the viscosity of the composition does not exceed about 400 cps over 4 weeks storage at 32° C.

2. The composition of claim 1 wherein the hydrophobic paper sizing agent is selected from the group consisting of cellulose reactive paper sizing compounds, cellulose non-reactive paper sizing compounds and mixtures thereof.

3. The composition of claim 1 wherein the dry weight of the hydrophobically modified poly(aminoamide) is from 0.5 to 50% based on dry weight of hydrophobic sizing agent.

4. The composition of claim 3 wherein the dry weight of the active hydrophobically modified poly(aminoamide) is from 1 to 20% based on dry weight of hydrophobic sizing agent.

5. The composition of claim 1 wherein the hydrophobic paper sizing agent is selected from cellulose non-reactive paper sizing compounds.

6. A method of preparing a sizing composition comprising:

a) preparing an aqueous phase comprising a dilute solution of a water soluble alkyl glycidyl ether modified poly (aminoamide) having a pH below 4.0, b) mixing at least one unemulsified hydrophobic sizing agent with the aqueous hydrophobically modified poly (aminoamide) to form a mixture, and c) homogenizing the mixture to form a stable oil-in-water emulsion; wherein the viscosity of the emulsion does not exceed about 400 cps over 4 weeks storage at 32° C.

7. The method of claim 6 wherein the hydrophobic paper sizing agent is selected from the group consisting of cellulose non-reactive paper sizing compounds, cellulose reactive paper sizing compounds or mixtures thereof.

8. The method of claim 6 wherein the hydrophobic paper sizing agent is selected from the group consisting of alkenyl succinic anhydride (ASA), alkyl ketene dimer (AKD), ketene dimers, ketene multimers, organic epoxides containing from about 12 to 22 carbon atoms, acyl halides containing from about 12 to 22 carbon atoms, fatty acid anhydrides from fatty acids containing from about 12 to 22 carbon atoms, organic isocyanates containing from about 12 to 22 carbon atoms or mixtures thereof.

9. The method of claim 7 wherein the hydrophobic paper sizing agent is a cellulose reactive compound selected from the group consisting of an alkenyl succinic anhydride, an alkyl ketene dimer or combinations thereof.

10. The method of claim 7 wherein the hydrophobic paper sizing agent is a cellulose non-reactive paper sizing compound selected from the group consisting of unmodified rosin, fortified rosin, rosin ester, hydrogenated rosin, extended rosin, wax, hydrocarbon resins and mixtures thereof.

11. The method of claim 10 wherein the cellulose non-reactive paper sizing compound comprises fortified rosin.

12. A method of sizing paper comprising:

a) providing an aqueous solution of a water soluble alkyl glycidyl ether modified poly(aminoamide) having a pH below 4.0, b) mixing an unemulsified hydrophobic sizing agent with the alkyl glycidyl ether modified poly(aminoamide) solution to form a mixture, c) homogenizing the mixture to form a stable oil-in-water emulsion, wherein the viscosity of the emulsion does not exceed about 400 cps over 4 weeks storage at 32° C., and d) applying the emulsified hydrophobic sizing agent to wood pulp.

13. The method of claim 12 wherein the hydrophobic sizing agent comprises fortified rosin.

* * * * *